US011393446B2

(12) United States Patent
Tinker

(10) Patent No.: US 11,393,446 B2
(45) Date of Patent: Jul. 19, 2022

(54) APPARATUS AND METHODS FOR AN ACOUSTIC NOISE CANCELLATION AUDIO HEADSET

(71) Applicant: Tempo Semiconductor, Inc., Austin, TX (US)

(72) Inventor: Darrell Tinker, Austin, TX (US)

(73) Assignee: Tempo Semiconductor, Inc., Austin, TX (US)

( * ) Notice: Subject to any disclaimer, the term of this patent is extended or adjusted under 35 U.S.C. 154(b) by 0 days.

(21) Appl. No.: 17/140,084

(22) Filed: Jan. 3, 2021

(65) Prior Publication Data

US 2021/0210065 A1 Jul. 8, 2021

Related U.S. Application Data

(60) Provisional application No. 62/956,786, filed on Jan. 3, 2020.

(51) Int. Cl.
*G10K 11/178* (2006.01)

(52) U.S. Cl.
CPC .. *G10K 11/17881* (2018.01); *G10K 11/17854* (2018.01); *G10K 2210/1081* (2013.01); *G10K 2210/3026* (2013.01); *G10K 2210/3027* (2013.01); *G10K 2210/3044* (2013.01); *G10K 2210/3051* (2013.01)

(58) Field of Classification Search
CPC ..... G10K 11/17879; G10K 11/17881; G10K 11/178; G10K 2210/3051
See application file for complete search history.

(56) References Cited

U.S. PATENT DOCUMENTS

2007/0098119 A1* 5/2007 Stothers ..... G10K 11/16 375/345

* cited by examiner

*Primary Examiner* — Kile O Blair
(74) *Attorney, Agent, or Firm* — Hunt Pennington Kumar PLLC

(57) ABSTRACT

A method and apparatus for acoustic noise cancellation ("ANC") in an audio headset. A combination of an analog feedforward path and at least one digital feedforward path enables the ANC facility to operate with the shorter delay inherent in analog electronics, but with the capability of better cancellation of reflections that digital feedforward allows.

11 Claims, 5 Drawing Sheets

APPARATUS AND METHODS FOR AN ACOUSTIC NOISE CANCELLATION AUDIO HEADSET

CROSS-REFERENCE TO RELATED APPLICATIONS

The present application is related and claims priority to U.S. Provisional Application 62/956,786, filed on Jan. 3, 2020, entitled Apparatus and Methods for an Acoustic Noise Cancellation Audio Headset, which is incorporated by reference in entirety.

BACKGROUND OF THE INVENTION

1. Field of the Invention

The present invention relates to an apparatus and methods for an acoustic noise cancellation audio headset.

2. Description of the Related Art

In general, in the descriptions that follow, I will italicize the first occurrence of each special term of art that should be familiar to those skilled in the art of integrated circuits ("ICs") and systems. In addition, when I first introduce a term that I believe to be new or that I will use in a context that I believe to be new, I will bold the term and provide the definition that I intend to apply to that term. In addition, throughout this description, I will sometimes use the terms assert and negate when referring to the rendering of a signal, signal flag, status bit, or similar apparatus into its logically true or logically false state, respectively, and the term toggle to indicate the logical inversion of a signal from one logical state to the other. Alternatively, I may refer to the mutually exclusive boolean states as logic_0 and logic_1. Of course, as is well known, consistent system operation can be obtained by reversing the logic sense of all such signals, such that signals described herein as logically true become logically false and vice versa. Furthermore, it is of no relevance in such systems which specific voltage levels are selected to represent each of the logic states.

Hereinafter, when I refer to a facility I mean a circuit or an associated set of circuits adapted to perform a particular function regardless of the physical layout of an embodiment thereof. Thus, the electronic elements comprising a given facility may be instantiated in the form of a hard macro adapted to be placed as a physically contiguous module, or in the form of a soft macro the elements of which may be distributed in any appropriate way that meets speed path requirements. In general, electronic systems comprise many different types of facilities, each adapted to perform specific functions in accordance with the intended capabilities of each system. Depending on the intended system application, the several facilities comprising the hardware platform may be integrated onto a single IC, or distributed across multiple ICs. Depending on cost and other known considerations, the electronic components, including the facility-instantiating IC(s), may be embodied in one or more single- or multi-chip packages. However, unless I expressly state to the contrary, I consider the form of instantiation of any facility that practices my invention as being purely a matter of design choice.

Further, when I use the term develop I mean any process or method, whether arithmetic or logical or a combination thereof, for creating, calculating, determining, effecting, producing, instantiating or otherwise bringing into existence a particular result. In particular, I intend this process or method to be instantiated, embodied or practiced by a facility or a particular component thereof or a selected set of components thereof, without regard to whether the embodiment is in the form of hardware, firmware, software or any combination thereof.

Audio headsets are used in many applications, for communications, hearing protection, or just listening to music. When used in noisy environments, it is desirable or even necessary to reduce the amount of noise reaching the ears. Acoustic Noise Cancellation ("ANC") is often used to accomplish this, wherein an anti-noise, opposite to the undesired noise, is electronically created and played through a speaker, reducing the volume of the noise. Many methods for accomplishing this are known, including both analog and digital methods; involving feedforward, feedback, or both.

The frequency range of the noise that can be cancelled is limited by several factors, including the delay through the electronics, the response of the speaker, and the bandwidth limitations of the components. If the delay can be reduced, then a higher bandwidth of noise can be cancelled. Also, if digital filters are used, the cost of the system may be lowered if methods can be found to reduce the size of the filter, for example, having fewer taps in a Finite Impulse Response ("FIR") filter. Power consumption, which is especially critical in battery powered portable systems, can be reduced if smaller filters are used, or if the sample rate of a digital filter is lowered. Some of these desirable qualities may be in conflict with each other. For example, a lower sample rate in a digital feedforward ANC system will increase the delay. Therefore, improvements are needed in ANC headsets.

BRIEF SUMMARY OF THE INVENTION

In accordance with a generic embodiment of my invention, I provide an ANC facility that includes a first digital feedforward circuit and a selected one of an analog feedforward circuit and a second digital feedforward circuit.

In accordance with a first specific embodiment of my invention, I provide an ANC facility that includes an analog feedforward circuit and a first digital feedforward circuit.

In accordance with a second specific embodiment of my invention, I provide an ANC facility that includes a first digital feedforward circuit and a second feedforward circuit.

In accordance with a third specific embodiment of my invention, I provide an ANC facility that includes an analog feedforward circuit, a first digital feedforward circuit, and a second feedforward circuit.

In accordance with yet another embodiment, an acoustic sound system may comprise an ANC facility adapted to practice any specific embodiment of my invention.

In accordance with still another embodiment, a non-transitory computer readable medium may include executable instructions which, when executed in a processing system, causes the processing system to perform the steps of any specific embodiment of my ANC method.

BRIEF DESCRIPTION OF THE SEVERAL VIEWS OF THE DRAWINGS

My invention may be more fully understood by a description of certain preferred embodiments in conjunction with the attached drawings in which.

Figure 1:
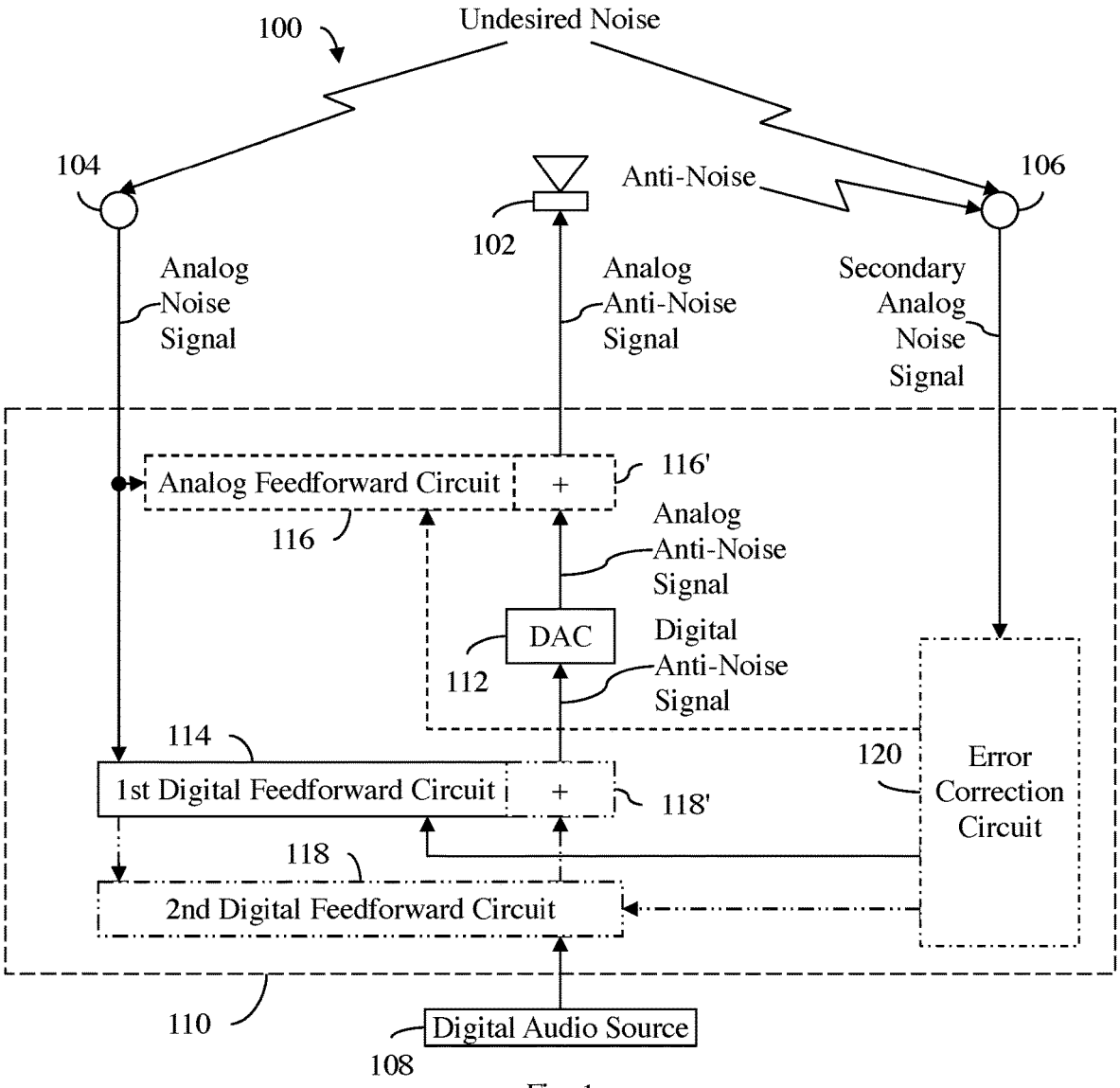
FIG. 1 illustrates, in block diagram form, an ANC facility comprising a generic embodiment of my invention.

In the drawings, similar elements will be similarly numbered whenever possible. However, this practice is simply for convenience of reference and to avoid unnecessary proliferation of numbers, and is not intended to imply or suggest that my invention requires identity in either function or structure in the several embodiments.

DETAILED DESCRIPTION OF THE INVENTION

I. Genus:

In FIG. 1, I have illustrated an acoustic audio system comprising an audio headset 100, which may be one of several known types, including over-ear or in-ear. In a typical noise cancellation embodiment, the headset 100 comprises a speaker 102, a first microphone 104, a second microphone 106, and other electronic components, including amplifiers (not shown).

In a basic configuration, the first analog microphone 104 is configured to receive an undesired acoustic noise signal, and adapted to produce an analog noise signal substantially proportional to the received undesired acoustic noise signal. The speaker 102 is configured to receive an analog anti-noise signal, and to emit an acoustic anti-noise signal proportional to the received analog anti-noise signal. The second analog microphone 106 is configured to receive the audio in the vicinity of the speaker 102, and to develop a secondary analog noise signal proportional to the combination of the undesired noise and the emitted acoustic anti-noise signal.

In one embodiment, the headset 100 may include a digital audio source 106 configured to produce a digital audio signal. In this embodiment, the digital audio signal will be mixed with a digital anti-noise signal before output to the speaker 102.

In accordance with my invention, headset 100 includes a generic embodiment of my ANC facility 110. A digital-to-analog converter ("DAC") 112: is configured to be connected in an operational mode to the analog speaker 102; and adapted: to receive the digital anti-noise signal; and to develop the analog anti-noise signal as a function of the received digital anti-noise signal. A first digital feedforward circuit 114 is: operably coupled to the first analog microphone 104; and adapted to receive the analog noise signal, to develop a digital noise signal proportional to the received analog noise signal, to develop at a first sample rate a first digital feedforward signal as a function of the digital noise signal, and to develop the digital anti-noise signal as a function of the first digital feedforward signal.

In a first specific embodiment, my ANC facility 110 includes an analog feedforward circuit 116 (dashed): operably coupled to the first analog microphone 104 and between the DAC 112 and the speaker 102; and adapted to receive the analog noise signal and the analog anti-noise signal, to develop an analog feedforward signal as a function of the received analog noise signal. In this first embodiment, the analog feedforward circuit 116 is further adapted (see, 116'): to mix the analog feedforward signal with the analog anti-noise signal.

In a second specific embodiment, my ANC facility 110 includes a second digital feedforward circuit 118 (double-_dot-dashed): operably coupled between the first digital feedforward circuit 114 and the DAC 112; and adapted to receive the digital noise signal and the digital anti-noise signal, and to develop at a second sample rate less than the first sample rate a second digital feedforward signal as a function of the received digital noise signal. In this second embodiment, the second digital feedforward circuit 118 is further adapted (see, 118'): to receive the digital anti-noise signal, and to mix the second digital feedforward signal with the received digital anti-noise signal.

In a third specific embodiment, my ANC facility 110 includes, in addition to the first digital feedforward circuit 114, both the analog feedforward circuit 116 and the second digital feedforward circuit 118.

In a fourth specific embodiment, my ANC facility 110 includes an error correction circuit 120. The error correction circuit 120 is: operably coupled to the second analog microphone 106; and adapted to receive the secondary analog noise signal, and to develop one or more of: a first error correction signal adapted to control the operation of the first digital feedforward circuit 114, a second error correction signal adapted to control the operation of the analog feedforward circuit 116, and a third error correction signal adapted to control the operation of the second digital feedforward circuit 118.

The combination of an analog feedforward path and at least two digital feedforward paths at different sample rates enables my ANC facility 110 to operate with the shorter delay inherent in analog electronics, but with the capability of better cancellation of reflections that digital feedforward allows. Also, operating digital feedforward at two sample rates allows a shorter filter length at a lower sample rate while still cancelling later reflections and ringing, while the higher sample rate feedforward fills in the response gap between the analog feedforward and the lower sample rate second digital feedforward. I submit that these innovations provide a good combination of minimum delay for good frequency response, and small size and low power while still cancelling later reflections and ringing.

Each of these embodiments realizes benefits of my invention. The embodiment with an analog feedforward and a single digital feedforward may have the same minimal delay associated with the analog feedforward as the full featured embodiment. The embodiment with two digital feedforwards at two sample rates and no analog feedforward may achieve a delay that is small relative to the electromechanical delays inherent in speakers if the first sample rate is high enough, while achieving the small size and low power that is possible with the lower second sample rate. The error correction circuit may be combined with any of these embodiments to enable the ANC facility to track circuit variations, or adapt to changes in the undesired noise, or to reduce the cost of product development, manufacturing and testing.

Figure 2:
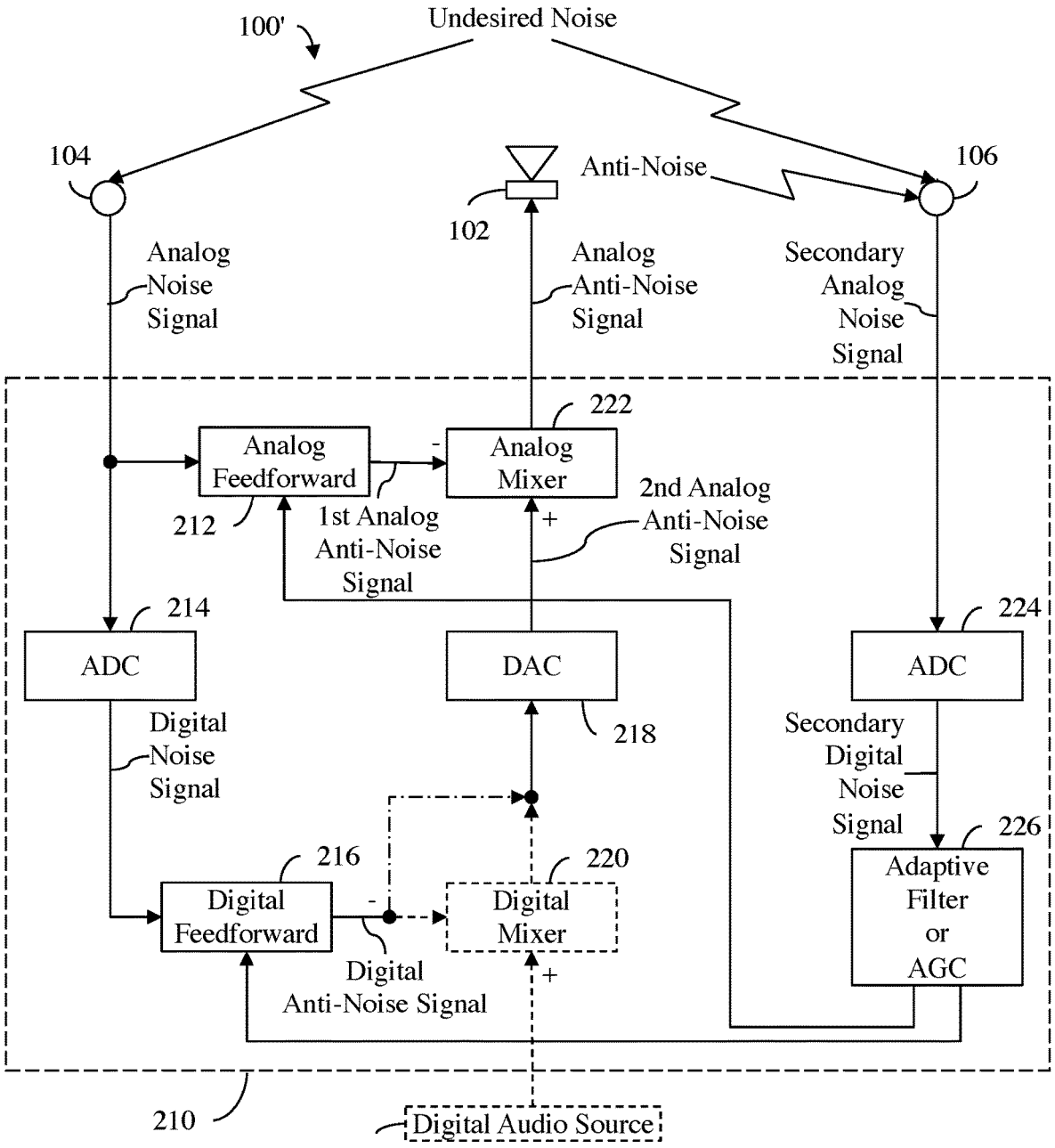
FIG. 2 illustrates, in block diagram form, an ANC facility adapted to practice a first specific embodiment of my invention.

II. Species I:

Shown in FIG. 2 is a first specific embodiment of the generic acoustic audio system of FIG. 1. I accordance with this first species of my invention, headset 100' includes one embodiment of my ANC facility 210 adapted to develop both analog and digital feedforward. An analog feedforward 212 receives the analog noise signal, and develops a first analog anti-noise signal. A first Analog to Digital Converter ("ADC") 214 also receives the analog noise signal, and develops a digital noise signal proportional to the analog noise signal. A digital feedforward 216 receives the digital noise signal, and develops a digital anti-noise signal. A DAC 218 receives the digital anti-noise signal, and develops a second analog anti-noise signal proportional to the digital anti-noise signal. In one embodiment, before being received by the DAC 218, a digital mixer 220 may mix the digital anti-noise signal with a digital audio signal from the digital audio source 108. An analog mixer 222 receives both the first and second analog anti-noise signals, and develops a mixed analog anti-noise signal. The output of the analog mixer 222 drives the speaker 102 through an amplifier (not shown). The anti-noise emitted through the speaker 102 cancels at least a portion of the undesired audio noise in the vicinity of the speaker 102. The second analog microphone 106 receives the audio in the vicinity of the speaker 102, and develops a secondary analog signal proportional to the combination of the undesired noise and the emitted anti-noise. A second ADC 224 receives the secondary analog noise signal, and develops a secondary digital noise signal proportional to the secondary analog noise signal. The secondary digital noise signal is used by {either an adaptive filter or an AGC} 226 to control at least one of: the gain of the analog feedforward 212; the gain of the digital feedforward 216; and the coefficients of the digital feedforward 216.

This ANC headset 100' has the advantage of the smaller delay inherent in analog feedforward, but with the ability to accurately cancel reflections and ringing that digital feedforward allows. The smaller analog delay allows higher frequency noise signals to be cancelled. By comparison, the delay through the ADC 214, digital feedforward 216, and DAC 218, in a practical system, is probably 4 to 6 sample periods. The digital feedforward 216 also allows my ANC facility 210 to compensate for the dynamic response characteristics of the speaker 102, which would be much more difficult to do with an analog feedforward 212 alone.

If an adaptive filter 226 is used to control the digital feedforward 216, then my ANC facility 210 can dynamically adapt to variations in the electronic components, and even to changes in the characteristics of the noise. This can result in better noise cancellation performance, and lower manufacturing cost.

Figure 3:
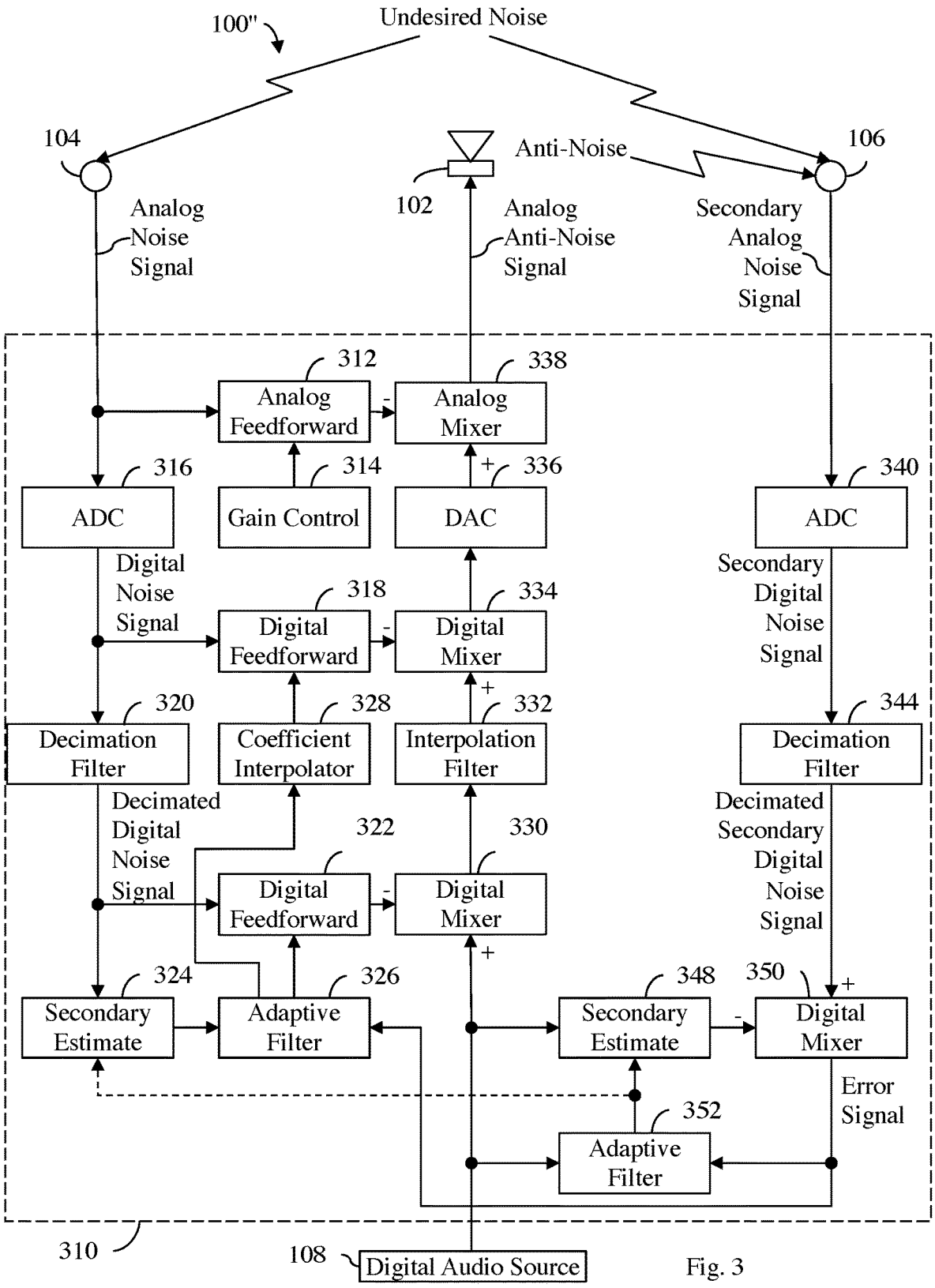
FIG. 3 illustrates, in block diagram form, an ANC facility adapted to practice a second specific embodiment of my invention.

III. Species II:

Shown in FIG. 3 is a second specific embodiment of the generic acoustic audio system of FIG. 1. In accordance with this second species of my invention, headset 100" includes one embodiment of my ANC facility 310 adapted to develop both analog and enhanced digital feedforward.

An analog feedforward 312 receives the analog noise signal, and develops a first analog anti-noise signal. In one embodiment, the analog feedforward 312 has a gain control 314, which may be set during a calibration mode, or continuously by an Automatic Gain Control ("AGC") (not shown). A first ADC 316 also receives the analog noise signal, and develops at a first sample rate a digital noise signal proportional to the analog noise signal. A first digital feedforward 318 receives the digital noise signal, and develops a first digital anti-noise signal. A decimation filter 320 also receives the digital noise signal, and develops a decimated digital noise signal at a second sample rate less than the first sample rate. In one embodiment, the second sample rate may be ⅛ of the first sample rate. A second digital feedforward 322 receives the decimated digital noise signal, and develops a second digital anti-noise signal. A first secondary estimate filter 324 also receives the decimated digital noise signal, and develops a first secondary estimate signal. A first adaptive filter 326 receives the first secondary estimate signal and an error signal, and develops a first set of coefficients and a second set of coefficients. A coefficient interpolator 328 interpolates the first set of coefficients to produce the coefficients for the first digital feedforward 318; the second set of coefficients comprises the coefficients for the second digital feedforward 322. In one embodiment, the adaptive filter 326 comprises a Least Mean Square ("LMS") filter.

The digital audio source 108 provides audio data at the second sample rate. A first digital mixer 330 receives the audio data and the negative of the second digital feedforward signal, and produces a first digital mix signal. An interpolation filter 332 develops an interpolated mix signal by interpolating the first digital mix at the first sample rate. A second digital mixer 334 develops a second digital mix signal by summing the interpolated mix signal with the negative of the first digital feedforward signal. A DAC 336 receives the second digital mix signal, and develops a second analog mix signal proportional to the second digital mix signal. An analog mixer 338 sums the second analog mix signal with the negative of the first analog anti-noise signal to drive the speaker 102 through an amplifier (not shown). The output of the speaker 102 comprises acoustic sound derived from the digital audio source 108, and anti-noise derived from the undesired noise received at the microphone 104, thus cancelling at least a portion of the undesired noise. The anti-noise comprises anti-noise components from the analog feedforward 312, the first digital feedforward 318, and the second digital feedforward 322. The component from the analog feedforward 312 has the least delay, and the component from the digital feedforward 322 has the most delay. The anti-noise component from the digital feedforward 318 fills in a time gap between the time the anti-noise component from the analog feedforward 312 and the time the anti-noise component from the digital feedforward 322 are received at the analog mixer 338. The time gap is present because of the delays through the decimation filter 320 and the interpolation filter 332.

A second ADC 340 receives the secondary analog noise signal, and develops a secondary digital noise signal. A second decimation filter 344 receives the secondary digital noise signal, and develops a decimated secondary digital noise signal. A second secondary estimate 348 receives the digital audio source signal, and develops an estimate of the component of the digital audio source signal that is present in the decimated secondary digital noise signal. A third digital mixer 350 subtracts this estimate from the decimated secondary digital noise signal to produce the error signal. A second adaptive filter 352 receives the digital audio source signal and the error signal, and produces the coefficients of the second secondary estimate 348. In one embodiment, the adaptive filter 352 comprises an LMS adaptive filter. In one embodiment, the first secondary estimate 324 and the second secondary estimate 348 may have substantially the same coefficients.

The adaptive filter 326 adjusts the first set of coefficients and the second set of coefficients such that any components of the undesired noise remaining in the error signal will be further cancelled by the anti-noise generated in the first digital feedforward 318 and in the second digital feedforward 322. The adaptive filter 352 adjusts the coefficients of the secondary estimate 348 such that any components of the digital audio source signal remaining in the error signal will be further reduced by the secondary estimate 348. In one embodiment, the adaptive filter 326 and the adaptive filter 352 may run concurrently. In another embodiment, the second adaptive filter 352 will run in a secondary calibration mode, and the adaptive filter 326 will run in an operational mode. The secondary estimate 348 and the digital mixer 350 together reduce the component of the digital audio source signal in the error signal, so that it will not interfere with the operation of the adaptive filter 326.

Figure 4:
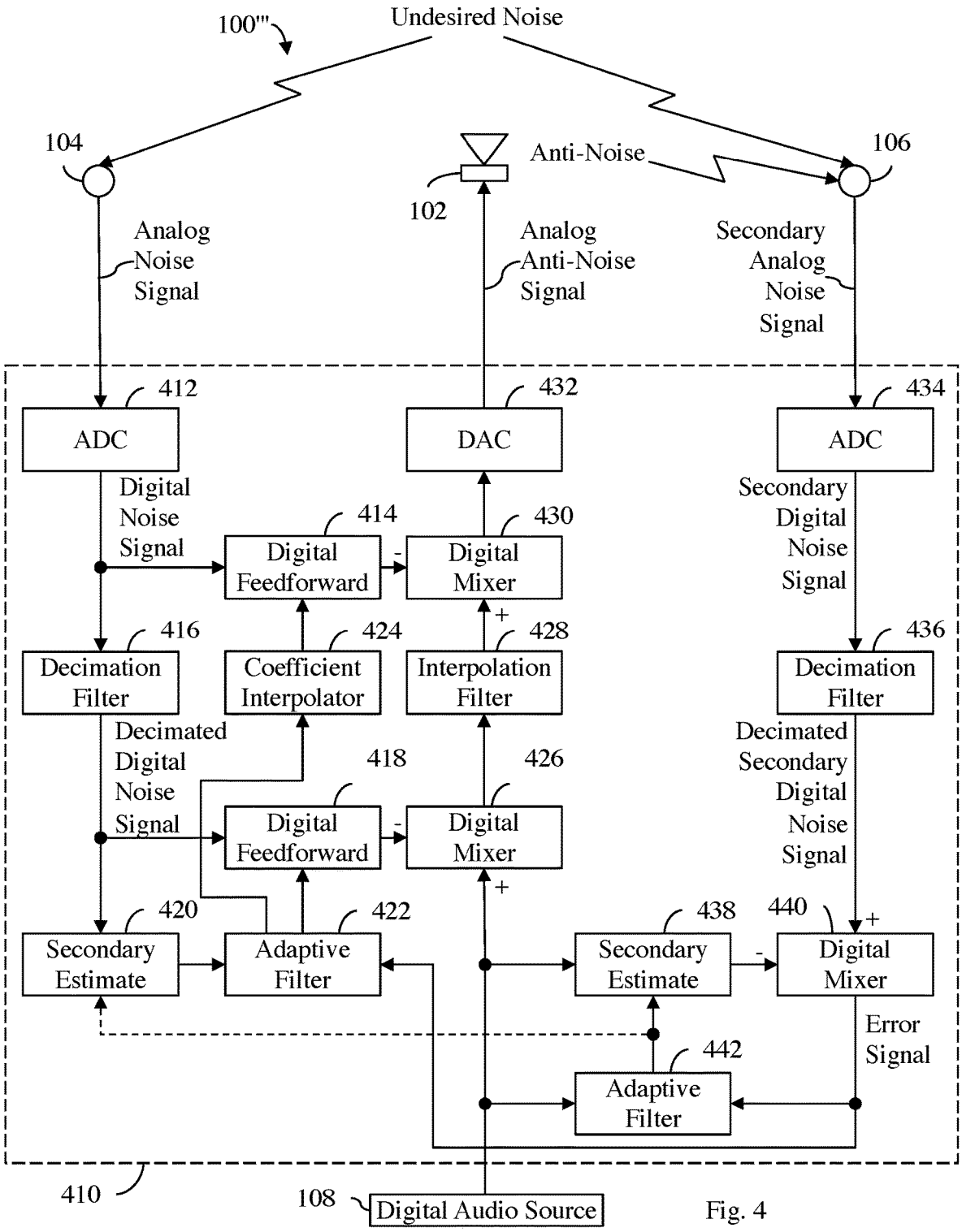
FIG. 4 illustrates, in block diagram form, an ANC facility adapted to practice a third specific embodiment of my invention.

IV. Species III:

Shown in FIG. 4 is a third specific embodiment of the generic acoustic audio system of FIG. 1. In accordance with this third species of my invention, headset 100''' includes one embodiment of my ANC facility 410 adapted to develop a multi-rate digital feedforward.

A first ADC 412 receives the analog noise signal, and develops at a first sample rate a digital noise signal proportional to the analog noise signal. A first digital feedforward 414 receives the digital noise signal, and develops a first digital anti-noise signal. A decimation filter 416 also receives the digital noise signal, and develops a decimated digital noise signal at a second sample rate less than the first sample rate. In one embodiment, the second sample rate may be ⅛ of the first sample rate. A second digital feedforward 418 receives the decimated digital noise signal, and develops a second digital anti-noise signal. A first secondary estimate filter 420 also receives the decimated digital noise signal, and develops a first secondary estimate signal. A first adaptive filter 422 receives the first secondary estimate signal and an error signal, and develops a first set of coefficients and a second set of coefficients. A coefficient interpolator 424 interpolates the first set of coefficients to produce the coefficients for the first digital feedforward 414; the second set of coefficients comprises the coefficients for the second digital feedforward 418. In one embodiment, the adaptive filter 422 comprises an LMS filter.

A first digital mixer 426 receives the audio data and the negative of the second digital feedforward signal, and produces a first digital mix signal. An interpolation filter 428 develops an interpolated mix signal by interpolating the first digital mix at the first sample rate. A second digital mixer 430 develops a second digital mix signal by summing the interpolated mix signal with the negative of the first digital feedforward signal. A DAC 432 receives the second digital mix signal, and develops an analog mix signal proportional to the second digital mix signal to drive the speaker 102 through an amplifier (not shown). The output of the speaker 102 comprises acoustic sound derived from the digital audio source 108, and anti-noise derived from the undesired noise received at the microphone 104, thus cancelling at least a portion of the undesired noise. The anti-noise comprises anti-noise components from the first digital feedforward 414, and the second digital feedforward 418.

A second ADC 434 receives the secondary analog signal, and develops a secondary digital noise signal. A second decimation filter 436 receives the secondary digital noise signal, and develops a decimated secondary digital noise signal. A second secondary estimate 438 receives the digital audio source signal, and develops an estimate of the component of the digital audio source signal that is present in the decimated secondary digital noise signal. A third digital mixer 440 subtracts this estimate from the decimated secondary digital noise signal to produce the error signal. A second adaptive filter 442 receives the digital audio source signal and the error signal, and produces the coefficients of the second secondary estimate 438. In one embodiment, the second adaptive filter 442 comprises an LMS adaptive filter. In one embodiment, the first secondary estimate 420 and the second secondary estimate 438 may have substantially the same coefficients.

The adaptive filter 422 adjusts the first set of coefficients and the second set of coefficients such that any components of the undesired noise remaining in the error signal will be further cancelled by the anti-noise generated in the first digital feedforward 414 and in the second digital feedforward 418. The adaptive filter 442 adjusts the coefficients of the secondary estimate 438 such that any components of the digital audio source signal remaining in the error signal will be further reduced by the secondary estimate 438. In one embodiment, the adaptive filter 422 and the adaptive filter 442 may run concurrently. In another embodiment, the second adaptive filter 442 will run in a secondary calibration mode, and the adaptive filter 422 will run in an operational mode. The secondary estimate 438 and the digital mixer 440 together reduce the component of the digital audio source signal in the error signal, so that it will not interfere with the operation of the adaptive filter 422.

If the digital feedforward blocks 414 and 418 comprise Finite Impulse Response ("FIR") filters, then the length of time covered by the impulse response is found by multiplying the sample period by the number of taps, or coefficients. Therefore, an impulse response of a particular length of time can be implemented with fewer taps, and therefore at a lower cost and lower power consumption, if the sample rate is lower, since the sample rate and sample period are reciprocals of each other. But the decimation and interpolation filters have inherent delays, which can add up to several sample periods even if minimum delay filters are used. This delay will lengthen the response time compared to operating at a higher sample rate, which will reduce the bandwidth of noise that can be cancelled by the ANC headset 100'''. On the other hand, running the feedforward at a higher sample rate would require multiple times more taps to cover the needed impulse response time. Therefore this invention provides a solution to both of these problems. The first digital feedforward 414 operating at the higher first sample rate generates its part of the anti-noise earlier, and only needs enough taps to fill the time until the interpolated second anti-noise signal arrives at the second digital mixer 430. The second digital feedforward 418 operating at the lower second sample rate requires much fewer taps than would be required if only the higher rate first digital feedforward 414 were present. For example, if the second sample rate is ⅛ of the first sample rate, then about ⅛ of the number of taps are required.

The first digital feedforward 414 and second digital feedforward 418 may both be controlled by a shared adaptive filter 422, operating at the second sample rate. The coefficients for the first digital feedforward 414 are interpolated from a first set of coefficients from the shared adaptive filter 422. For example, if the second sample rate is ⅛ of the first sample rate, then 8 coefficients would be interpolated between each pair of coefficients in the first set. Because the second digital feedforward 418 and the shared adaptive filter 422 are both operating at the second sample rate, the coefficients of the second digital feedforward 418 may comprise a second set of coefficients from the shared adaptive filter 422. The first secondary estimate 420, second secondary estimate 438, and second adaptive filter 442 may operate in the same manner as described with respect to the similar blocks in the preferred embodiment in FIG. 3, but this invention does not require identical correspondence between the blocks in FIG. 3 and FIG. 4.

V. Variable Leak LMS Adaptive Filter.

A common type of adaptive filter is the Least Mean Square filter. If the filter has N coefficients, each coefficient is calculated by the equation:

$$Wi<=Wi+Mu*\text{Error}*Xi;$$

Wherein "<=" represents assignment, Wi is the coefficient number i, numbered from 0 to N−1, Mu is the step size, Error is the current value of an error signal, and Xi is sample i of a reference signal. The system operates such that the coefficients converge to values that minimize the correlation between the reference signal and the error signal. For example, if the first adaptive filter 422 in FIG. 4 is an LMS filter, the coefficients of the digital feedforward blocks would be adjusted such that the anti-noise cancels out most of the undesired noise that would otherwise be present in the error signal.

One known variation of the LMS filter is the leaky LMS, wherein in each new coefficient calculation, a small fraction of the coefficient is subtracted, or to put it another way, the coefficient is multiplied by a number slightly less than 1, L in this equation:

$$Wi<=L*Wi$$

For the purpose of this disclosure, I shall define the tail of the filter as comprising the coefficients representing greater delay of the input signal in producing the filter output, and greater delay of the reference signal (relative to the error signal) in calculating the filter coefficients. In so far as I am aware, leaky LMS filters have only been done previously with all coefficients using the same leak. In general, in the prior art, the leak, L, will be applied equally to all coefficients, Wi, of the LMS filter. The leak may be implemented with a shift and subtract if L is chosen to be 1 minus a small power of 2. The shift and subtract will require less hardware than a multiplier, which would be required to support an arbitrary leak. A larger leak means a smaller value of L, and if L is 1 minus a power of 2, a larger leak means a larger power of 2; but the power of 2 must always be much smaller than 1 so that it does not overpower the LMS calculation.

In my leaky LMS filter, I progressively increase the leak toward the tail of the LMS filter. In one embodiment, I increase the step size of the leak toward the tail, thereby increasing the slope of the leak changes. The leak may be implemented with a shift and subtract, by duty cycling or piecewise linear increases, all of which can be done with simple hardware, thus avoiding multipliers.

Studies have shown that in many applications an LMS filter will converge more rapidly when leaky LMS is used. But the presence of the leak requires that some small error always be present to keep adjusting the coefficients enough to overcome the leak.

In LMS adaptive filters, an important design decision is how many coefficients to use, the number N. If N is too small, there may still be energy in the error signal after a correlated event in the reference signal has passed beyond the end of the filter. This may lead to convergence problems in the coefficients at the tail end of the filter, as i approaches N. So a solution for this problem could allow fewer coefficients to be acceptable, thus lowering the cost of the LMS adaptive filter. I have discovered that using a leaky LMS filter can improve the convergence in the tail of an LMS filter. However, the level of leak needed to adequately control the tail coefficients may be more than is optimal for the rest of the filter, and therefore the LMS converges to a sub-optimal point wherein the error is larger than it would be with an optimal convergence.

This invention uses a variable leak, wherein there is a baseline leak in most of the LMS coefficient calculations, but the leak increases toward the tail end of the filter. So if (Li=1-LEAKi), LEAKi will be a minimum value (LEAKmin) for (i<start), and LEAKi will increase for (i>start) as i approaches N.

Figure 5:
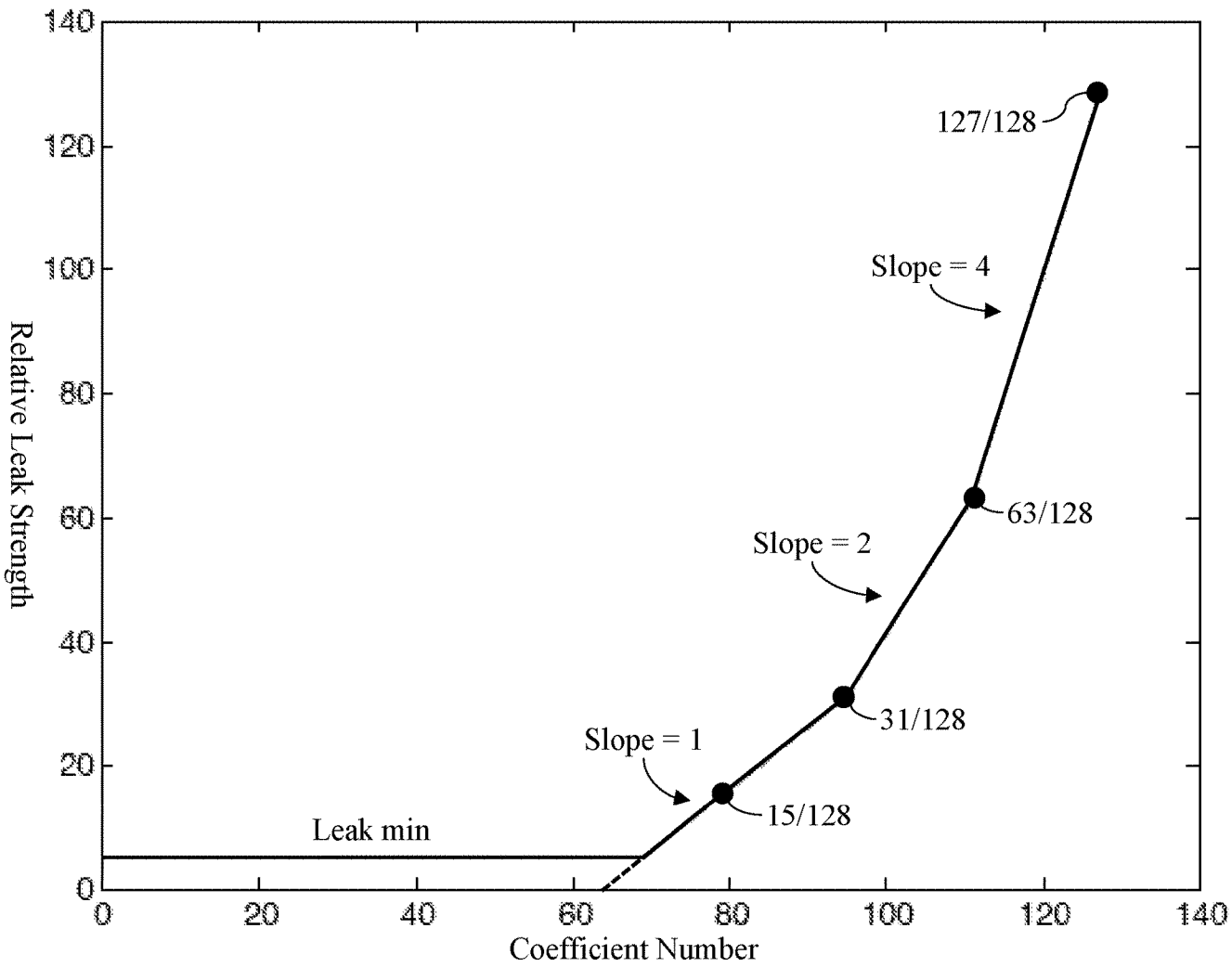
FIG. 5 illustrates, in graph diagram form, one possible mode of operation of a leaky LMS filter in accordance with one embodiment of my invention.

FIG. 5 shows an example of an embodiment using a piecewise linear method, wherein the leak steps are initially a minimum size (delta), then increase by (2*delta), and finally (4*delta), reaching a maximum leak for coefficient Wi with (i=N−1).

The (L*Wi) calculation may be performed with a hardware multiplier, but this requires a large number of additions. If LEAKi is a power of two, then the multiplication can be performed with a shift and subtract, requiring much less hardware. Non-power-of-two leak strengths can be supported with this shift and subtract method by duty cycling the leak, for example, by enabling the leak any number from 0 to 127 out of 128 cycles. This will work well in an LMS filter, because the step size Mu is chosen so that the Wi coefficients only make small changes, and the maximum leak is also small, so that it will not be larger than the (Mu*Error*Xi) calculations over many cycles. In one embodiment, the cycles with an active leak will be distributed as uniformly as possible over the total number of cycles.

One embodiment of this duty cycling leak is this method: Let LEAKi be a 7 bit binary integer (from 0 to 127 in equivalent decimal), representing the relative leak strength for Wi; let COUNT be a 7 bit binary counter that counts continuously from 0 to 127 (modulo 128), advancing one step for each complete set of Wi LMS coefficient calculations (i progressing from 0 to N−1). Here is a snippet of verilog code representing the decision tree to determine whether to leak in a particular cycle for a particular Wi calculation:

```
Do_Leak=(COUNT[0]==1'b1)?LEAKi[6]://64 leaks

(COUNT[1:0]==2'b10)?LEAKi[5]://32 leaks

(COUNT[2:0]==3'b100)?LEAKi[4]://16 leaks

(COUNT[3:0]==4'b1000)?LEAKi[3]://8 leaks

(COUNT[4:0]==5'b10000)?LEAKi[2]://4 leaks

(COUNT[5:0]==6'b100000)?LEAKi[1]://2 leaks

(COUNT[6:0]==7'b1000000)?LEAKi[0]:1'b0;//1 or 0
    leaks
```

One experienced in verilog code and digital design will see that each selection in this decision tree is mutually exclusive. Depending on the value of LEAKi, the leak will be performed anywhere from 0 to 127 times out of each 128 complete LMS cycles, that is, over the period wherein COUNT passes through all 128 possible values. Also, the active leak cycles will be distributed as evenly as possible over each period of 128 LMS cycles.

In a more general form, my method for calculating the leak factors starts with a first predetermined set, W, of coefficient values. Next, I calculate a second set, W', of coefficient values, wherein each is a function of: the product of a respective one of the first set of coefficient values with a leak factor no greater than 1; and a further function of a reference value sample and an error sample, wherein the reference value sample is progressively delayed relative to the error sample. Then, as the delay of the reference sample relative to the error sample is increased beyond a predetermined delay, the leak factor is progressively varied: from a first leak factor to a second leak factor smaller than the first leak factor; and from the second leak factor to a third leak factor smaller than the second leak factor.

In one other embodiment, my ANC facility 110 may comprise a general purpose digital signal processor ("DSP") instantiated within an audio system 100, such as is shown in FIG. 1. In such an embodiment, my method may be embodied in a non-transitory computer readable medium including executable instructions which, when executed, causes the system 100 to perform the steps of any desired embodiment of my ANC method.

Although I have described my invention in the context of particular embodiments, one of ordinary skill in this art will readily realize that many modifications may be made in such embodiments to adapt either to specific implementations. Without departing from the substance of my invention, in any of the specific embodiments of my invention disclosed herein, a conventional digital microphone may be substituted for any of the analog microphones and the associated ADCs; and such a digital microphone may, if desired, include a decimation filter. Further, in any specific embodiment, the DAC [112:218:336:432] may comprise a switching amplifier. Thus it is apparent that I have provided several specific embodiments of an ANC facility [110:210:310:410], each of which is both effective and efficient. Further, I submit that my method and apparatus provide performance generally superior to the best prior art techniques.

What I claim is:

1. An acoustic noise cancellation ("ANC") facility for use in an acoustic sound system comprising:
- a first analog microphone:
  - configured to receive an undesired acoustic noise signal; and
  - adapted to produce an analog noise signal substantially proportional to the received undesired acoustic noise signal; and
- a speaker:
  - configured to receive an analog anti-noise signal; and
  - adapted to produce an acoustic anti-noise signal substantially proportional to the received analog anti-noise signal; and the ANC facility comprising:
- a digital-to-analog converter ("DAC"):
  - adapted:
    - to receive a digital anti-noise signal; and
    - to develop the analog anti-noise signal as a function of the received digital anti-noise signal;
- a first digital feedforward circuit:
  - operably coupled:
    - to the first analog microphone; and
    - to the DAC; and
  - adapted:
    - to receive the analog noise signal; and
    - to develop:
      - a digital noise signal proportional to the received analog noise signal;
      - at a first sample rate, a first digital feedforward signal as a function of the digital noise signal; and
      - the digital anti-noise signal as a function of the first digital feedforward signal; and a selected one of:
- an analog feedforward circuit:
  - operably coupled:
    - to the first analog microphone; and
    - to the DAC; and
  - adapted:
    - to receive:
      - the analog noise signal; and
      - the analog anti-noise signal; and
    - to develop an analog feedforward signal as a function of the received analog noise signal; and
    - to mix the analog feedforward signal with the received analog anti-noise signal; and
- a second digital feedforward circuit:
  - operably coupled between the first digital feedforward circuit and the DAC; and
  - adapted:
    - to receive:
      - the digital noise signal; and
      - the digital anti-noise signal;
    - to develop at a second sample rate less than the first sample rate, a second digital feedforward signal as a function of the received digital noise signal; and
    - to mix the second digital feedforward signal with the received digital anti-noise signal.

2. The ANC facility of claim 1:

wherein the acoustic sound system further comprises:
- a second analog microphone:
  - configured:
    - to receive an undesired acoustic noise signal; and
    - to receive the acoustic anti-noise signal; and
  - adapted:
    - to produce a secondary analog noise signal substantially proportional to the combination of the received undesired acoustic noise signal and the received acoustic anti-noise signal; and wherein the ANC facility further comprises:
- an error cancellation circuit:
  - operably coupled to the second analog microphone; and
  - adapted:
    - to receive the secondary analog noise signal; and
    - to develop at least one of:
      - a first error correction signal adapted to control the operation of the first digital feedforward circuit;
      - a second error correction signal adapted to control the operation of the analog feedforward circuit; and
      - a third error correction signal adapted to control the operation of the second digital feedforward circuit.

3. The ANC facility of claim 2 wherein the error cancellation circuit is further characterized as developing a selected one of:
- the first error correction signal using a first leaky least means square ("LMS") filter;
- the second error correction signal using a second leaky LMS filter; and
- the third error correction signal using a third leaky LMS filter.

4. The ANC facility of claim 3 wherein a selected one of the first, second and third leaky LMS filters is further characterized as being adapted:

to calculate N coefficients, each calculated as:

$$Wi<=(L*Wi)+(Mu*\text{Error}*Xi)$$

wherein:

"<=" represents assignment;

Wi is the coefficient number i, numbered from 0 to N−1;

Mu is the step size;

Error is the current value of an error signal;

Xi is sample i of a reference signal; and

L is a leak factor; and selectively to vary L progressively:

from a first leak factor to a second leak factor smaller than the first leak factor; and from the second leak factor to a third leak factor smaller than the second leak factor, the third leak factor being less than 1.

5. The ANC facility of claim 3 wherein a selected one of the first, second and third leaky LMS filters is further characterized as being adapted:

to calculate, from a first predetermined set, W, of coefficient values, a second set, W', of coefficient values, wherein each coefficient value is a function of:

the product of a respective one of the first set of coefficient values with a leak factor not greater than 1; and a further function of a reference value sample and an error sample, wherein the reference value sample is progressively delayed relative to the error sample; and wherein, as the delay of the reference sample relative to the error sample is increased beyond a predetermined delay, the leak factor is progressively varied:

from a first leak factor to a second leak factor smaller than the first leak factor; and from the second leak factor to a third leak factor smaller than the second leak factor.

6. The ANC facility of claim 1 wherein the first digital feedforward circuit is further characterized as comprising:

a first analog-to digital converter ("ADC"):

operably coupled to the first analog microphone; and adapted:

to receive the analog noise signal; and to develop the digital noise signal proportional to the received analog noise signal;

a first digital feedforward:

operably coupled to the first ADC; and adapted:

to receive the digital noise signal; and to develop a first digital feedforward signal as a function of the received digital noise signal.

7. The ANC facility of claim 6 wherein the analog feedforward circuit further comprises:

an analog feedforward:

operably coupled to the first analog microphone; and adapted:

to receive the analog noise signal; and to develop an analog feedforward signal as a function of the received analog noise signal; and an analog mixer:

operably coupled:

to the analog feedforward; and to the first DAC; and adapted:

to receive:

the analog feedforward signal; and the analog anti-noise signal; and to mix the received analog feedforward signal with the received analog anti-noise signal.

8. The ANC facility of claim 6 wherein the second digital feedforward circuit is further characterized as comprising:

a first decimation filter:

operably coupled to the first ADC; and adapted:

to receive the digital noise signal; and to develop a decimated digital noise signal;

a second digital feedforward:

operably coupled to the first decimation filter; and adapted:

to receive the decimated digital noise signal; and to develop a second digital feedforward signal as a function of the received decimated digital noise signal;

an interpolation filter:

operably coupled to the second digital feedforward; and adapted:

to receive the second digital feedforward signal; and to develop an interpolated second digital feedforward signal; and a first digital mixer:

operably coupled:

between the first digital feedforward and the DAC; and to the interpolation filter; and adapted:

to receive:

the first digital feedforward signal; and the interpolated second digital feedforward signal;

to mix the received interpolated second digital feedforward signal with the received first digital feedforward signal.

9. The ANC facility of claim 1:

wherein the system further comprises:

a digital audio source configured to produce a digital audio signal; and wherein, in the ANC facility, a selected one of:

the first digital feedforward circuit is further characterized as being:

operably coupled to the digital audio source; and adapted:

to receive the digital audio signal; and to mix the received digital audio signal with the digital anti-noise signal; and the second digital feedforward circuit is further characterized as being:

operably coupled to the digital audio source; and adapted:

to receive the digital audio signal; and to mix the received digital audio signal with the second digital feedforward signal.

10. An acoustic sound system comprising:

a first analog microphone:

configured to receive an undesired acoustic noise signal; and adapted to produce an analog noise signal substantially proportional to the received undesired acoustic noise signal;

a speaker:

configured to receive an analog anti-noise signal; and adapted to produce an acoustic anti-noise signal substantially proportional to the received analog anti-noise signal; and an acoustic noise cancellation ("ANC") facility constructed in accordance with claim 1.

11. A non-transitory computer readable medium including executable instructions which, when executed in a processing system, causes the processing system to perform the steps of a method according to claim 1.

* * * * *